US012219988B1

(12) United States Patent
Almonte

(10) Patent No.: US 12,219,988 B1
(45) **Date of Patent: *Feb. 11, 2025**

(54) METHOD AND APPARATUS FOR STORAGE OF BULK SMOKABLE CONES

(71) Applicant: IP TRADEMARK HOLDINGS INC, Mandeville, LA (US)

(72) Inventor: Pedro Almonte, Santiago (DO)

(73) Assignee: IP TRADEMARK HOLDINGS INC, Mandeville, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/321,298

(22) Filed: May 22, 2023

Related U.S. Application Data

(62) Division of application No. 18/063,908, filed on Dec. 9, 2022, now Pat. No. 11,653,693.

(51) Int. Cl.
*A24C 5/46* (2006.01)

(52) U.S. Cl.
CPC ..... *A24C 5/46* (2013.01)

(58) Field of Classification Search
None
See application file for complete search history.

(56) References Cited

U.S. PATENT DOCUMENTS 11,653,693 B1 * 5/2023 Almonte ..... A24C 5/46
131/280

* cited by examiner

*Primary Examiner* — Phu H Nguyen
(74) *Attorney, Agent, or Firm* — Roy Kiesel Ford Doody & North, APLC; Brett A. North

(57) ABSTRACT

A conical smoking shell storage apparatus, comprising of a container having a top panel, one or more side walls, an interior and a plurality of lower frustoconically shaped inserts detachable supported in a generally vertical condition and parallel to each other via cooperating upper and lower openings. Multiple nested conical smoking shells can be supported in each of the frustoconically shaped inserts which provide support from bending, wrinkling, or damage to the sidewalls of the nested conical smoking shells with a plurality of upper frustoconically shaped inserts on the top of stack of nested conical smoking shells.

20 Claims, 10 Drawing Sheets

METHOD AND APPARATUS FOR STORAGE OF BULK SMOKABLE CONES

CROSS-REFERENCE TO RELATED APPLICATIONS

This is a divisional of U.S. patent application Ser. No. 18/063,908 (issuing as U.S. Pat. No. 11,653,693 on May 23, 2023), filed on Dec. 9, 2022, the entirety of each of which applications and/or patents are incorporated herein by reference. Priority to/of each of these applications and/or patents is hereby claimed.

BACKGROUND OF THE INVENTION

The present invention relates to an improved method and apparatus for constructing finished smoking products wherein a storage container holding multiple stacks of nested conical smoking shells for storage in a nested configuration without damage for future use in fabricating multiple custom smokable products.

Many smokers prefer to use their own smokable filler product as opposed to purchasing ready to smoking products that are already constructed and filled with a manufacturer's selection of smokable filler. These users of fine, custom smokable fillers prefer to purchase an empty preformed conical smoking shell, and then fill it with their own custom smokable filler.

The process of consumers making their own custom finished smoking product from pre-formed blanks typically employs an outer shell which can be conical or frustoconical shaped. The conical smoking shells are then filled with a smokable material such as a custom smokable filler. These conical smoking shells typically have thin walls (e.g., rice paper) which can bend, wrinkle, or otherwise become damaged when stored in a nested condition. The bending, wrinkling, or other damage to the thin walls reduces desirability to consumers.

There is a need for a storage system for storing multiple nested conical smoking shells that minimizes or eliminates damage to the conical smoking shell during storage and before use.

SUMMARY OF THE INVENTION

In various embodiments is provided a conical smoking shell storage apparatus that employs a specially configured container having a top panel, one or more side panels, an interior, and a plurality of frustoconically shaped inserts supported in a generally vertical condition.

In various embodiments, each conically smoking shell is generally conically shaped and further comprising nesting one shell inside another shell. In various embodiments, the conically smoking shells stored while nested one inside another.

In various embodiments, each conical smoking shell has a tapered shape.

In various embodiments, the conical smoking shell storage apparatus includes a container that is a box having multiple flat sides.

In various embodiments, the frustoconically shaped inserts are generally vertically positioned.

In various embodiments, a plurality of conical smoking shells are provided, each conical smoking shell sized and shaped to removably fit in a nested condition in a respective frustoconically shaped insert.

In various embodiments the frustoconically shaped inserts can be pliable and deformable material, such as paper, plastic, metal and the like, that is capable of retaining a frustoconical shape when supporting multiple nested smokable conical shells. In various embodiments the stiffness of the frustoconically shaped inserts can be greater than the stiffness of the sidewalls of the multiple nested smokable conical shells. In various embodiments the multiple nested conical smoking shells can each include a filter tip contained in the interior of their respective conical smoking shell, and the filter tip has a stiffness which is greater than the stiffness of the sidewall of the conical smoking shell. In various embodiments the stiffness of the frustoconically shaped inserts is greater than the stiffness of the sidewalls of the multiple nested smokable conical shells but less than the stiffness of the filter tip.

In various embodiments the conical smokable shells can be comprised of smokable materials chosen from any combination of the following materials: natural leaf, homogenized tobacco paper, pipe tobacco, different types of flavored tobacco, cellulose (clear, opaque, or colored), bleached or non-bleached paper, cigarette paper, rice paper, herbal materials, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, hemp, Hemia salicifolia, Kava Kava, *Avena Sativa*, scotch broom topps, Valarian, capillarius, herba, Wild clip dagga, *Leonurus sibiricus*, Kanna, Sinicuichi, chocolate, herbal components, and/or *Lactuca virosa*.

In various embodiments the conical smoking shell, frustoconically shaped inserts, filter tips, and/or smokable filler can include liquid for moisturizing, and also preferably includes flavoring and/or scenting. The liquid can be, in whole or in part, water, alcohol, solvent, oil, propylene glycol, ethyl alcohol, glycerin, benzyl alcohol as examples. The liquid can be flavored and/or scented with items such as for example apple, apple martini, berries, blueberry, champagne, chocolate, coco/vanilla, cognac, cosmo, gin, grape, honey, lychee, mango, menthol, mint choco, peach, piña colada, punch, purple, rum, strawberry/kiwi, vanilla, watermelon, wet cherry, and/or whiskey. This flavored liquid is typically applied at levels of between about 0.01 to 45% by weight, and preferably between about 0.1% to 10% by weight. This flavored liquid is typically applied to the at least one pre-rolled sheet with a carrier liquid such as ethyl alcohol, propylene glycol, water or the like. Glycerin and invert sugar can also be used as a carrier. Some humectants can also be used, however, little or no humectants can be used. In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils. In various embodiments terpene flavors can be used. In various embodiments other flavors can be non-characteristic flavors which include but are not limited to classic, blue, and Amersterdam While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF DESCRIPTION OF DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Conical Smoking Shell and Damage

Figure 1:
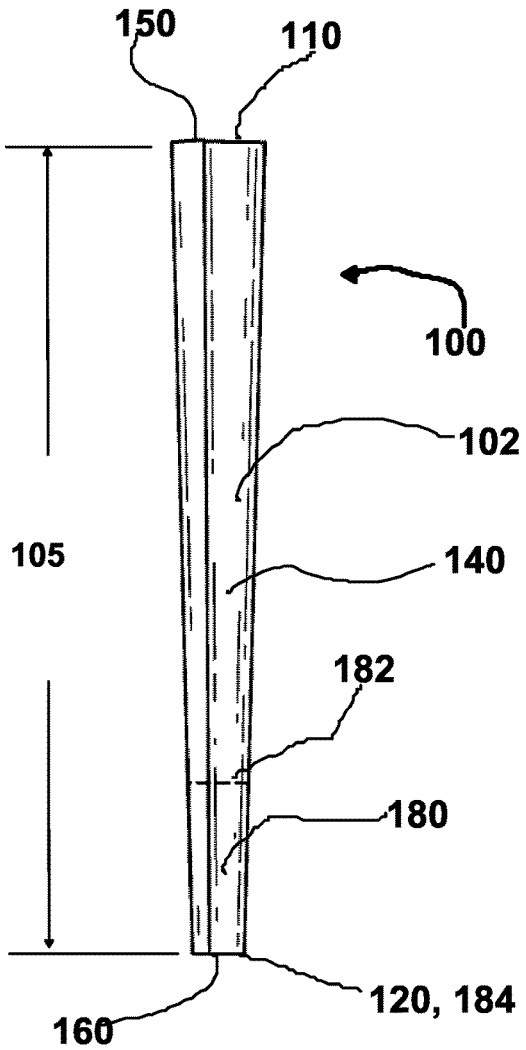
FIG. 1 is a perspective view of conical smoking shell by itself which can be constructed by conventional methods.
Figure 2:
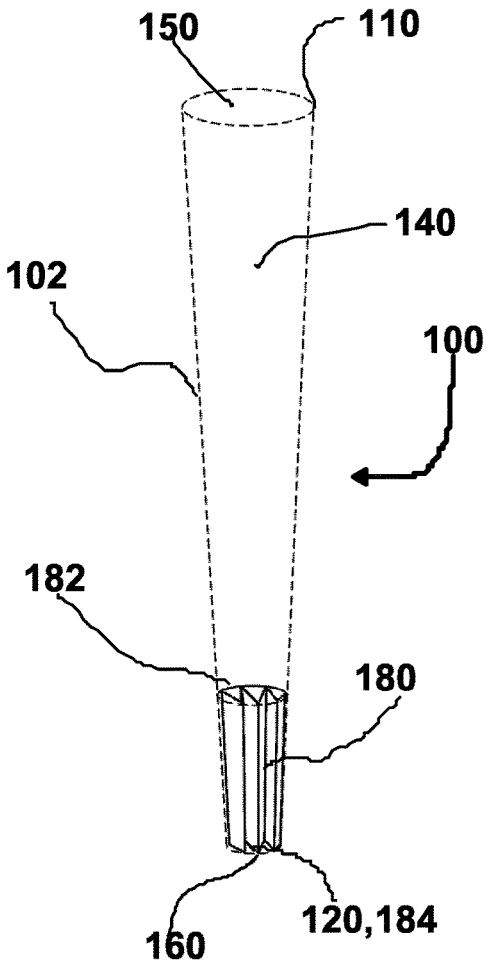
FIG. 2 is a perspective view of the conical smoking shell of FIG. 1 showing a filter tip.

FIG. 1 is a perspective view of conical smoking shell 100 by itself which can be constructed by conventional methods. FIG. 2 is a perspective view of the conical smoking shell 100 showing a filter tip 180. Conical smoking shell 100 can include first end 110, second end 120, outer surface 140, and filter tip 180. At first end 110 can be first opening 150. At second end 120 can be second opening 160. First opening 150 can be larger than second opening 160 giving first conical smoking shell 100 its conical shape. Between first end 110 and second end 120 is interior portion 114.

Figure 3:
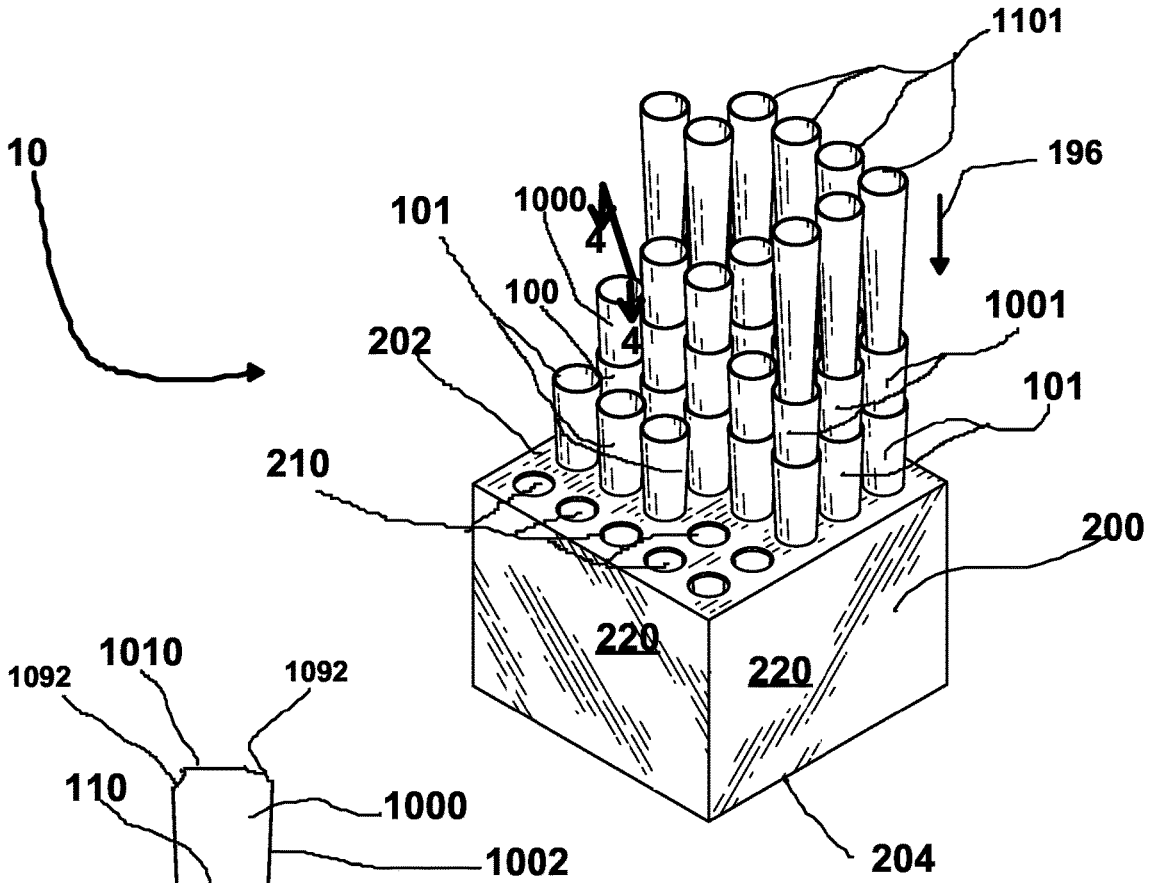
FIG. 3 is a perspective view showing a various conical smoking shells supported in a container in a nested condition.
Figure 4:
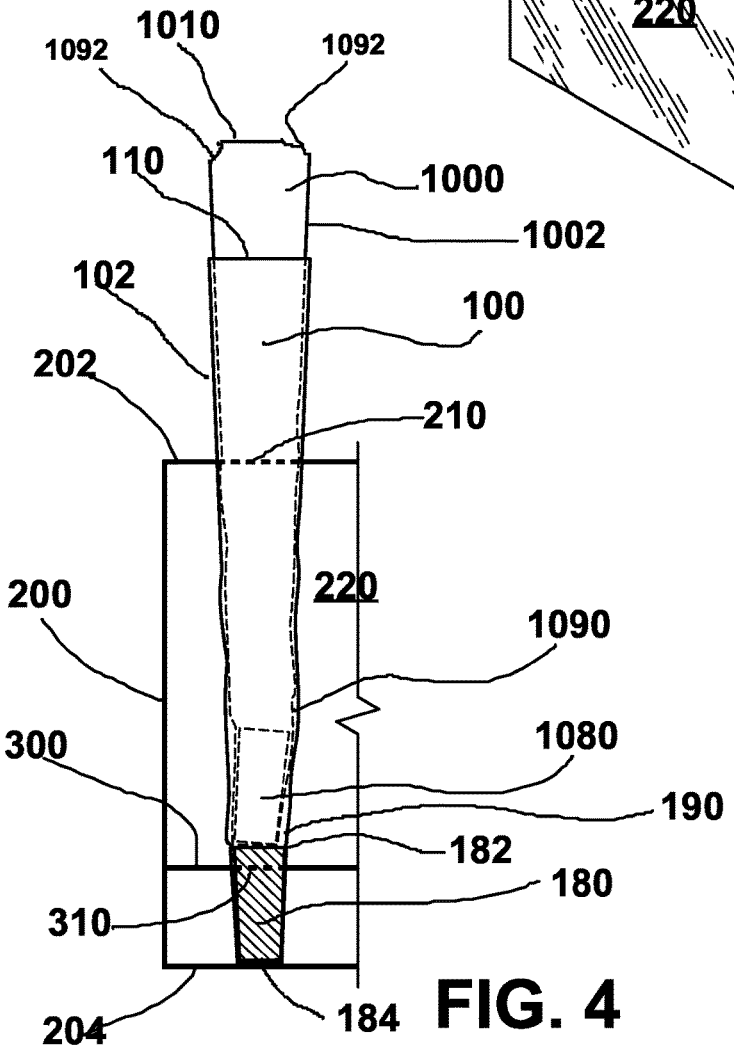
FIG. 4 is a sectional view of a stack of nested conically smoking shells supported in the container of FIG. 3, and taken along the lines 4-4 insert and illustrating wrinkling or damage to the sidewalls of the nested conical smoking shells.

FIG. 3 is a perspective view showing various conical smoking shells 101,1001, and 1101 supported in a container 200. Sidewall 102 of outer surface 140 of conical smoking shells 100 is weak and can wrinkle/deflect/tear when nested with one or more other conical smoking shells Outer surface 140 of sidewall 102 of conical smoking shell 101,1001 can wrinkle/deflect/tear if not directly supported. FIG. 4 is a sectional view of a stack of nested conical smoking shells 101, 1001 supported in the container 200 and illustrating wrinkling or damage 1090 to the conical smoking shells 101, 1001 (see e.g., FIG. 4). Additionally, the top of the stack of nested conical smoking shells (cone 1000 in FIG. 4) can become damaged by vertical movement of the stack of nested cones while being held such as by contacting an upper portion of a closed storage container 200 (see e.g., top 260 in FIG. 10 and wrinkled/folded/damaged portion 1092 in FIG. 4 of top conical smoking shell 1000).

Opposed Frustoconically Shaped Inserts or Supports and Storage Container

Figure 5:
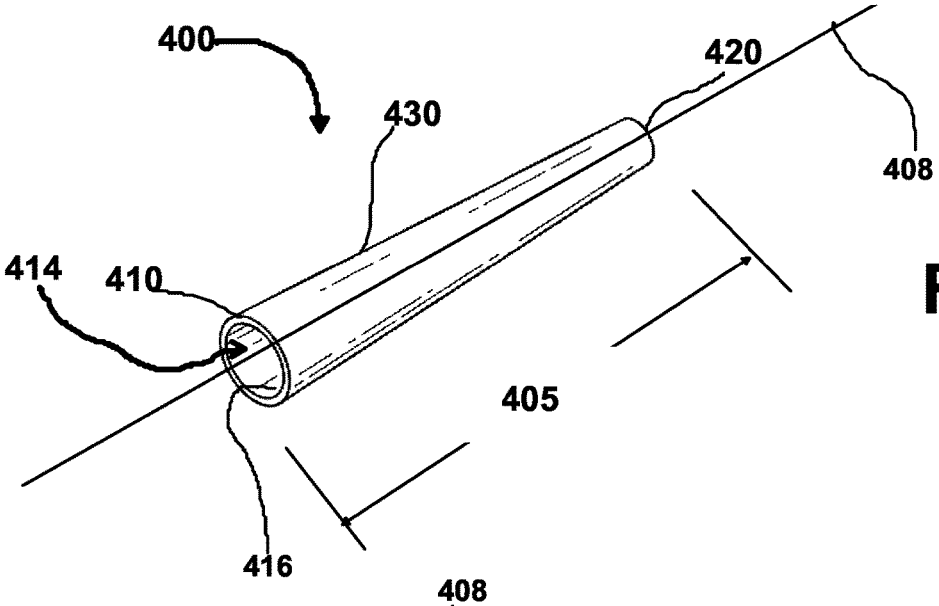
FIG. 5 is a perspective view of a frustoconically shaped insert or support.

FIG. 5 is a perspective view of a first frustoconically shaped insert or support 400. Frustoconically shaped insert 400 has a top 410, bottom 420, sidewall 430, interior 416, and longitudinal centerline 408. Frustoconically shaped insert 400 can be pliable and deformable material, such as paper, plastic, metal and the like, that is capable of retaining a frustoconical shape when supporting multiple nested conical smoking shells.

In various embodiments the stiffness of frustoconically shaped insert 400 can be greater than the stiffness of the sidewalls 102 of the multiple nested smokable conical shells 100. In various embodiments the multiple nested conical smoking shells 100 can each include a filter tip 180 contained in the interior of their respective conical smoking shell 100, and the filter tip 180 has a stiffness which is greater than the stiffness of the sidewall 102 of the conical smoking shell 100. In various embodiments the stiffness of the frustoconically shaped inserts 400 can be greater than the stiffness of the sidewalls 102 of the multiple nested smokable conical smoking shells 100 but less than the stiffness of the filter tips 180.

Preferably outer sidewall 416 of frustoconically shaped insert 400 closely conforms to sidewall 102 of conical smoking shell 100 which provides support to sidewall 102 and prevents wrinkling, bending, or other damage.

Figure 11:
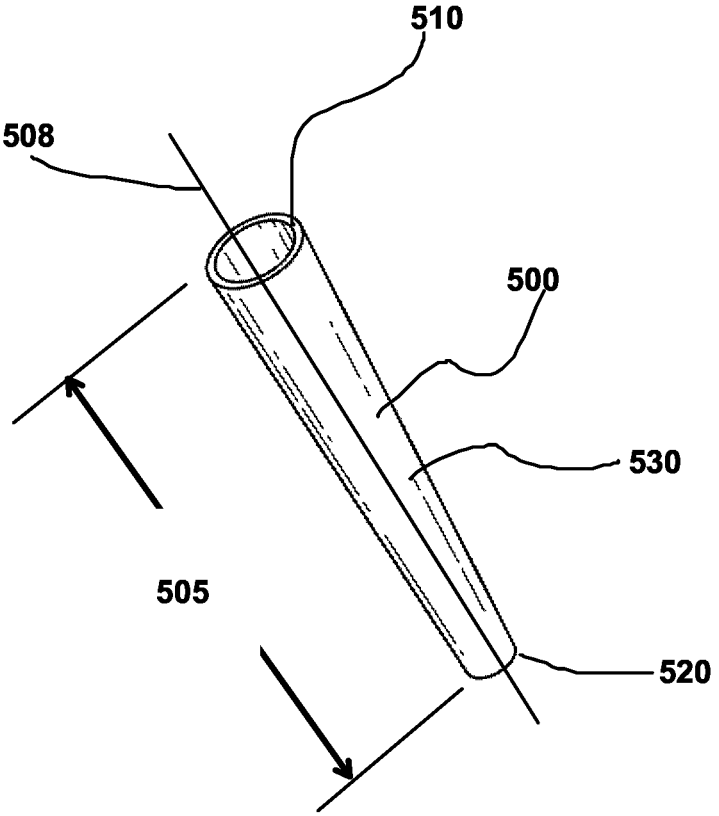
FIG. 11 is perspective view of a second frustoconically shaped insert or support which can be used as an upper support for each individual stack of a plurality of nested conical smoking shells.

FIG. 11 is perspective view of an upper frustoconically shaped insert or support 500 which can be used as an upper support for each individual stack of a plurality of nested conical smoking shells. Upper frustoconically shaped insert or support 500 has a top 510, bottom 520, sidewall 530, and longitudinal centerline 508. Upper frustoconically shaped insert or support 500 can be pliable and deformable material, such as paper, plastic, metal and the like, that is capable of retaining a frustoconical shape when at least partially inserted in the interior of a conical smoking shell (e.g., conical smoking shell 100, 1000, 1100, etc.).

In various embodiments the stiffness of upper frustoconically shaped insert or support 500 can be greater than the stiffness of the sidewalls of the multiple nested smokable conical shells which are nested below insert or support 500. In various embodiments the stiffness of the upper frustoconically shaped insert or support 500 can be greater than the stiffness of the sidewalls of the multiple nested smokable conical smoking shells which are nested below insert or support 500, but less than the stiffness of the filter tips 180 of these conical shells. In various embodiments the stiffness of upper frustoconically shaped insert or support 500 can be less than the stiffness of lower frustoconically shaped insert or support 400, but greater than the stiffness of the sidewalls of the multiple nested smokable conical smoking shells which are nested between upper 500 and lower 400 inserts or supports.

Preferably outer sidewall 530 of upper frustoconically shaped insert or support 500 closely conforms to the interior of the conical smoking shell that it is at least partially inserted in the interior of (e.g., the upper most conical smoking shell 100, 1000, 1100, etc.) and thereby provides support and resists wrinkling, bending, or other damage to the conical smoking shell.

Storage Container with Only Lower Frustoconically Shaped Insert or Support

Figure 6:
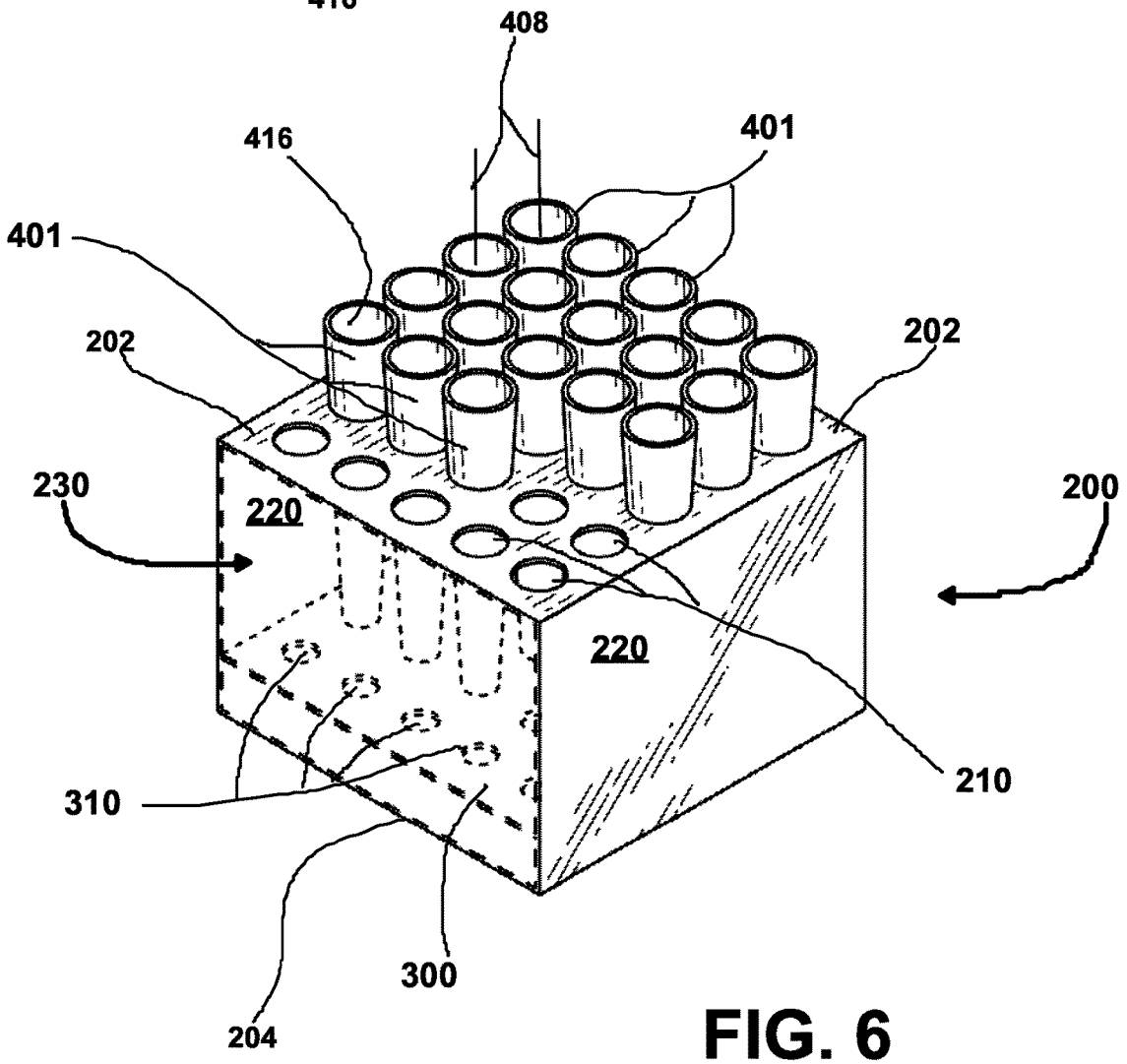
FIG. 6 is a perspective view showing the specially configured container of FIG. 4 having a plurality of frustoconically shaped inserts or supports which themselves are supported in a generally vertical condition.

FIGS. 6 through 10 schematically show storage container 200 with a plurality of lower frustoconically shaped inserts or supports 400 (e.g., pluralities 402 and 403), in combination with storage container 200, providing support to the sidewalls 102 of conical smoking shells 100 to be held in a generally vertical orientation. Each frustoconically shaped insert 400, in combination with storage container 200, can provide support to the sidewalls of a set of nested conical smoking shells 103 to be held in a generally vertical orientation. A plurality of frustoconically shaped inserts 401, in combination with storage container 200, can provide support to the sidewalls of a plurality of sets of nested conical smoking shells 103 to be held in a generally vertical orientation FIG. 6 is a partial cutout view of a specially configured container 200 having a top panel 202, one or more side panels 220, an interior 230, a lower panel 300, and a plurality of frustoconically shaped inserts 401 supported in a generally vertical condition, where the inserts 400 are each ready to accept a plurality of conical smoking shells (e.g., 100).

Figure 7:
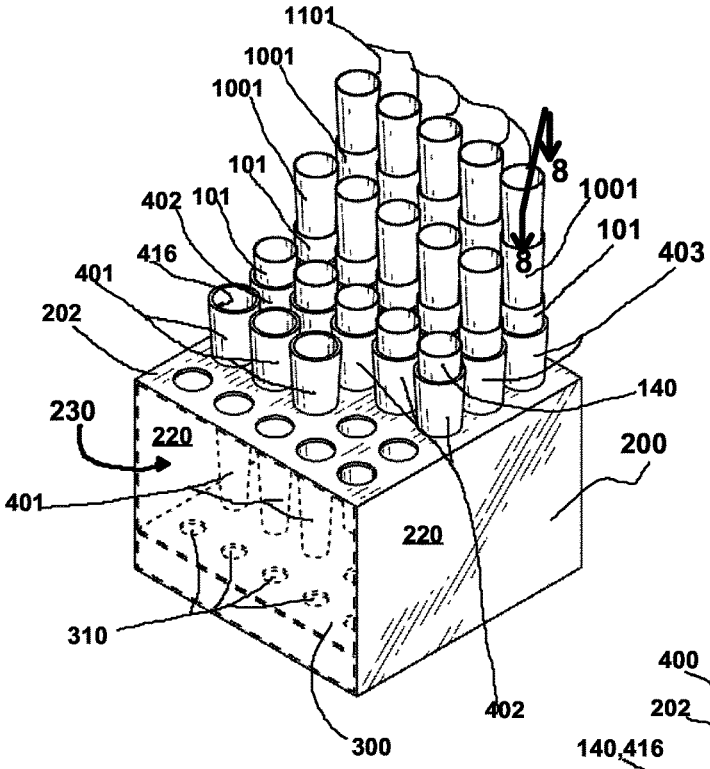
FIG. 7 is a perspective view showing the specially configured container of FIG. 6 now with: (i) some of the frustoconical shaped inserts or supports having no conical smoking shells, (ii) other of the frustoconical shaped inserts or supports having single conical smoking shells, and (iii) still others of the frustoconical shaped inserts supports having a plurality of nested conical smoking shells.
Figure 8:
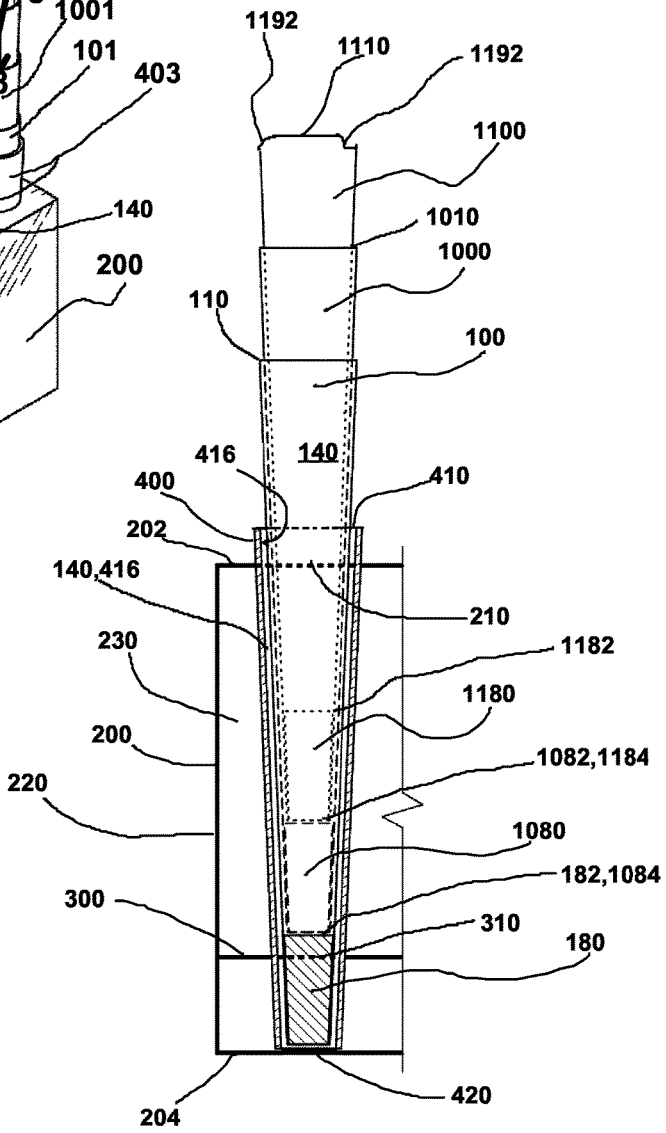
FIGS. 8 and 9 are sectional views of FIG. 7 taken along the lines 8-8 and schematically illustrating a frustoconical shaped insert or support supporting a nested stack of a plurality of conical smoking shells without any wrinkling or damage to any of the sidewalls in the smoking shells.
Figure 9:
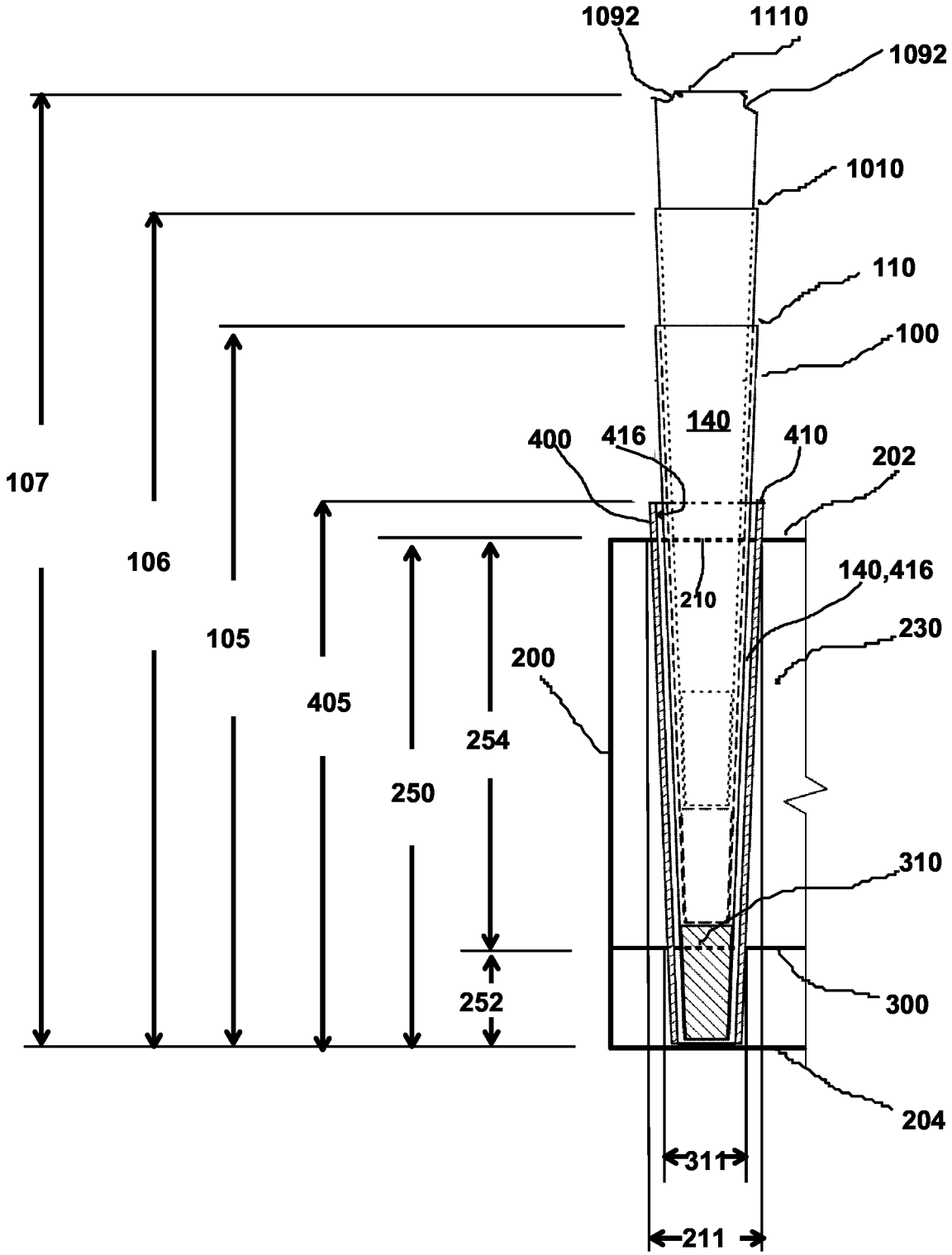

A plurality of frustoconically shaped inserts 400 can be supported by storage container 200 via respective openings 210/310 and in turn respectively support one or more nested conical smoking shells 100, 1000, 1100, etc. As best shown in FIGS. 7 through 9, outer surface 140 of lowermost conical smoking shell 100 contacts directly inner sidewall 416 of frustoconically shaped insert 400, and inner insert sidewall 416 supports and protects from damage sidewall 102 of conical smoking shell 100. Outer surface 140 of next lowermost conical smoking shell 1000 contacts directly sidewall 416 of lowermost conical smoking shell 100 which in turn is in direct contact with inner sidewall 416 of frustoconically shaped insert 400. Outer surface 140 of second next lowermost conical smoking shell 1100 contacts directly the sidewall of conical smoking shell 1000, which in turn is in direct contact with conical smoking shell 100, which conical smoking shell 100 is in turn is in direct contact with inner sidewall 416 of lower frustoconically shaped insert or support 400. This pattern can be repeated for each of set of nested conical smoking shells supported by a respective frustoconically shaped insert 400. In such manner lower frustoconically shaped insert or support 400 can protect nested conical smoking shells 100, 1000, 1100, etc. from wrinkling, folding, bending, or damage 1090 when stored in storage apparatus 200.

Top panel 202 of storage container 200 includes a plurality of upper openings 210. Lower panel 300 includes a plurality of lower openings 310 which respectively align with the plurality of upper openings 210. Preferably, plurality of upper openings 210 are larger than plurality of lower openings 310 whose respective relative opening sizes (see 211 and 311 in FIG. 9) are preferably determined based on both: (i) the slope of sidewall 430 of lower frustoconically shaped support 400 and (ii) the distance/spacing 254 between top panel 202 and lower panel 300 for a tight or snug fit for each lower frustoconically shaped insert 400 with both of its respective upper opening 210 and lower opening 310. In such manner each lower frustoconically shaped insert 400 can be held in a generally vertical position without substantial horizontal play between the lower frustoconically shaped insert 400 and storage container 200. Furthermore, preferably each longitudinal centerline 408 of the plurality of lower frustoconically shaped inserts 400 can be held generally parallel to the other longitudinal centerlines 408 of the plurality of lower frustoconically shaped inserts 400 (schematically shown in FIG. 6). Keeping parallel the various longitudinal center lines 408 of adjacent lower frustoconically shaped supports 400 increases the number of conical smoking shells 100 that nested together in each of the lower frustoconical shaped insert 400 without substantial damaging side contact (and possibly bending/wrinkling/damaging) other sets of nested conical smoking shells 100 located in immediately adjacent lower frustoconical shaped inserts 400. Additionally, keeping parallel the various longitudinal centerlines 408 of adjacent lower frustoconically shaped inserts 400 allows said supports 400 to be "packed" closer together without substantial side to side contact (and possibly bending/wrinkling/damaging) other sets of nested conical smoking shells 100 located in immediately adjacent lower frustoconical shaped inserts 400. Preferably, the plurality of lower frustoconical shaped inserts 400 are inserted into respective upper openings 210 without permanently affixing said supports 400 to storage container 200. That way the plurality of lower frustoconical shaped inserts 400 can be selectively removed from storage container 200 (which lower insert or support 400 removal would also removes the plurality of conical smoking shells 100 that are nested in the selected lower frustoconical shaped insert 400). In such manner a stack of nested plurality of conical smoking shells 100 can be held by the selected lower frustoconically shaped insert 400 without damaging any of the conical smoking shells 100 in the nested stack. Alternatively, in various embodiments one or more of the lower frustoconical support inserts 400 can be permanently attached or affixed to the top 202 of storage container 200 (in which embodiments interior shelf 300 can be omitted). In various embodiments one or more of the lower frustoconical support inserts 400 can be formed as a single unit with the top 202 of storage container 200 (e.g., inserts 400 and top 202 of storage container 200 can be combined in a pre-formed tray).

As schematically shown in FIG. 6, in various embodiments the plurality of adjacent frustoconically shaped inserts or supports 400 are "packed" so closely that each lower frustoconically shaped insert or support in the plurality is in contact with at least one other lower frustoconically shaped insert or support in the plurality of frustoconically shaped inserts or supports 400. In various embodiments the plurality of adjacent lower frustoconically shaped inserts 400 are "packed" so closely that each lower frustoconically shaped insert or support in the plurality is in contact with at least two other lower frustoconically shaped inserts or supports in the plurality of lower frustoconically shaped inserts or supports 400. In various embodiments the plurality of adjacent lower frustoconically shaped inserts or supports 400 are "packed" so closely that each lower frustoconically shaped insert or support in the plurality is in contact with at least three other lower frustoconically shaped inserts or supports in the plurality of lower frustoconically shaped inserts or supports 400. In various embodiments the plurality of adjacent lower frustoconically shaped inserts or supports 400 are "packed" so closely that each lower frustoconically shaped insert or support in the plurality is in contact with at least four other lower frustoconically shaped inserts or supports in the plurality of lower frustoconically shaped inserts or supports 400.

As shown in FIGS. 6 through 9, each lower frustoconically shaped insert or support 400 can extend above top 202 of storage container 200, through its respective upper opening 210, into interior 230, and through its respective lower opening 310 of interior shelf or panel 300. As shown in FIGS. 8 and 9 bottom or second end 420 of lower frustoconically shaped insert or support 400 is preferably in contact with bottom 204 of storage container 200 so that bottom 204 aids in the support (beyond the support to lower frustoconically shaped insert or support 400 provided by top 202 and interior or shelf 300). Alternatively, one or more bottom or second end 420 of lower frustoconically shaped insert 400 can be spaced apart (not shown) from bottom 204 of storage container 200 so that support to frustoconically shaped insert 400 is provided by top 202 and interior or shelf 300 where bottom or second 420 is located between bottom 204 and interior or shelf 300. Such spacing apart provides the benefit of allowing some vertical movement of bottom 204 (e.g., bottom 204 may be flexible) without such movement of the bottom 204 causing a vertical movement of any of the lower frustoconically shaped inserts or supports 400 and the conical smoking shells nested in any said lower frustoconically shaped inserts or supports 400.

Lower frustoconically shaped insert or support 400 has a strong sidewall 416 which resists deformation and will protect from wrinkling or bending a conical smoking shell 100 placed inside insert 400. This can be contrasted to FIG. 4 showing a plurality of nested conical smoking shells 100 being supported without a frustoconically shaped insert 400 and illustrating lower wrinkling or damage 1090 to the conical smoking shells 100.

FIG. 7 is a perspective view showing a fully closed container 200 having a top panel 260, one or more side panels 220, an interior 270, and a plurality of lower frustoconically shaped inserts or supports 400 supported in a generally vertical condition, with: (i) some of the lower frustoconical shaped inserts or supports 400 having no conical smoking shells 100, 1000, 1100, etc., (ii) other of the lower frustoconical shaped inserts or supports 400 having single conical smoking shells 100, and (iii) still others of the lower frustoconical shaped inserts supports 400 having a plurality of nested conical smoking shells (e.g., shells 100, 1000, 1100, etc.).

FIGS. 8 and 9 are sectional views of FIG. 7 taken along the lines 8-8 and schematically illustrating a lower frustoconical shaped insert 400 supporting a plurality of nested conical smoking shells 101, 1001, and 1101 without any lower wrinkling, bending, folding, or damage 1090 to any of the sidewalls in the smoking shells. However, some upper wrinkling, bending, folding, or damage 1192 is noted to the uppermost nested conical smoking shell or cone 1100 in this stack of nested conical smoking shells. Such uppermost damage can be caused by longitudinal movement of the entire stack of the stack of plurality of nested conical smoking shells. Although lower frustoconical insert of support 400 protects against lower wrinkling, bending, folding, or damage, it will not protect against uppermost wrinkling, bending, folding, or damage which may occur if part or all of the stack moves longitudinally away from bottom 204 of container 200 and contacts the upper enclosure of the container.

Figure 10:
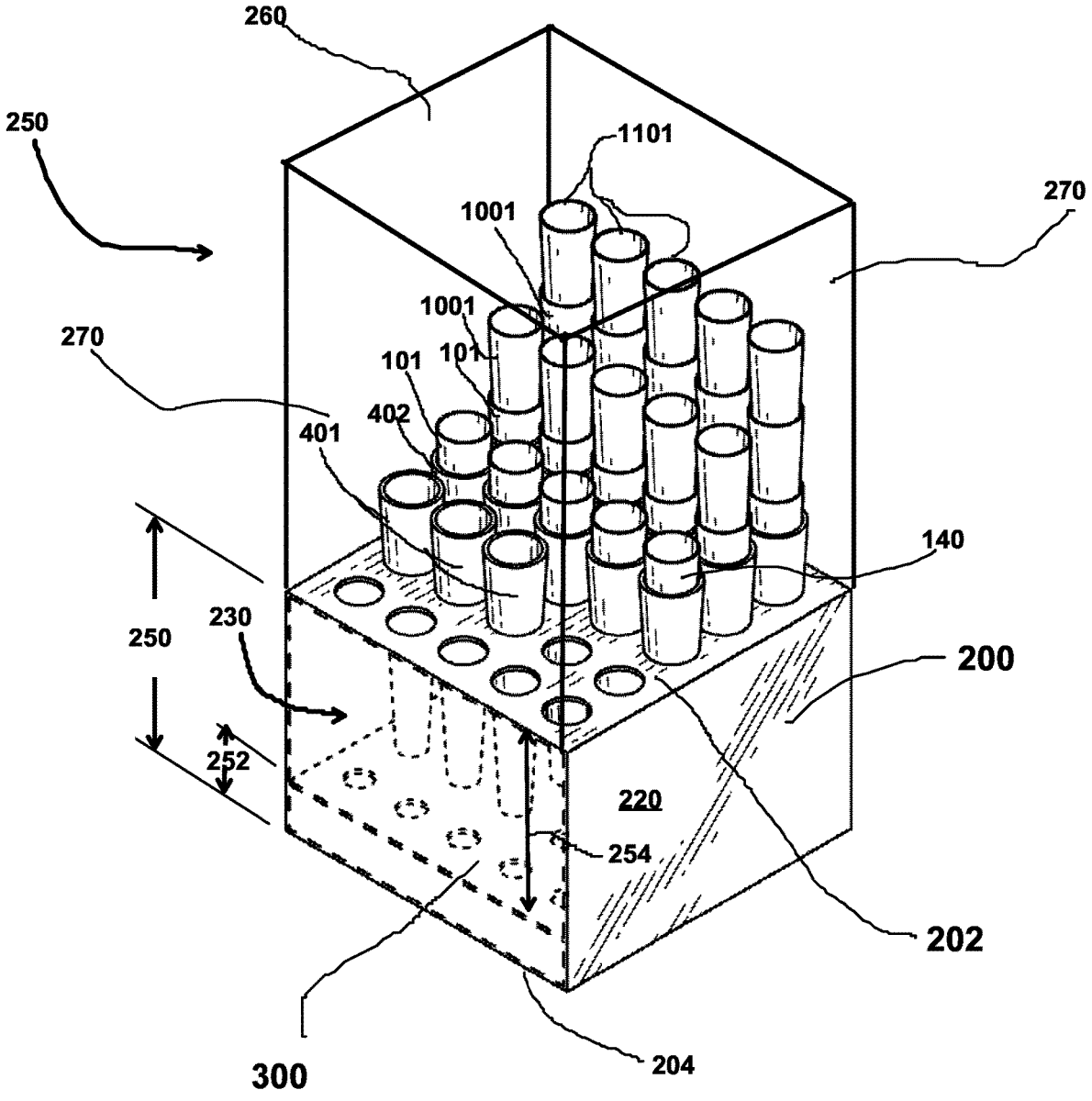
FIG. 10 is a perspective view showing a fully closed specially configured container having a top panel, one or more side panels, an interior, and a plurality of frustoconically shaped inserts or supports supported in a generally vertical condition, with: (i) some of the frustoconical shaped inserts or supports having no conical smoking shells, (ii) other of the frustoconical shaped inserts or supports having single conical smoking shells, and (iii) still others of the frustoconical shaped inserts supports having a plurality of nested conical smoking shells.

FIG. 10 is a perspective view showing a fully encased specially configured container 200 having a top panel 202, one or more side panels 220, and a plurality of lower frustoconically shaped inserts or supports 400 supported in a generally vertical condition, with some of these lower frustoconically shaped inserts supporting one or more conical smoking shells in a nested condition (e.g., 101, 1001, and 1101). To fully encase container 200 cover 250 with plurality of walls 270 and top 260 can be slid over container 200 such that plurality of conical smoking shells 100 are contained in the interior 255 of cover 250. In various embodiments cover 250 can have an open bottom and be slid on top of container 200. In various embodiments top 260 can be a lid which can be opened (e.g., removable cap or a hinged lid).

In various embodiments container 200 can be of various different shapes such cubes, cuboids, prisms, pyramids, platonic solids, torus, cone, cylinder, and sphere.

Figure 12:
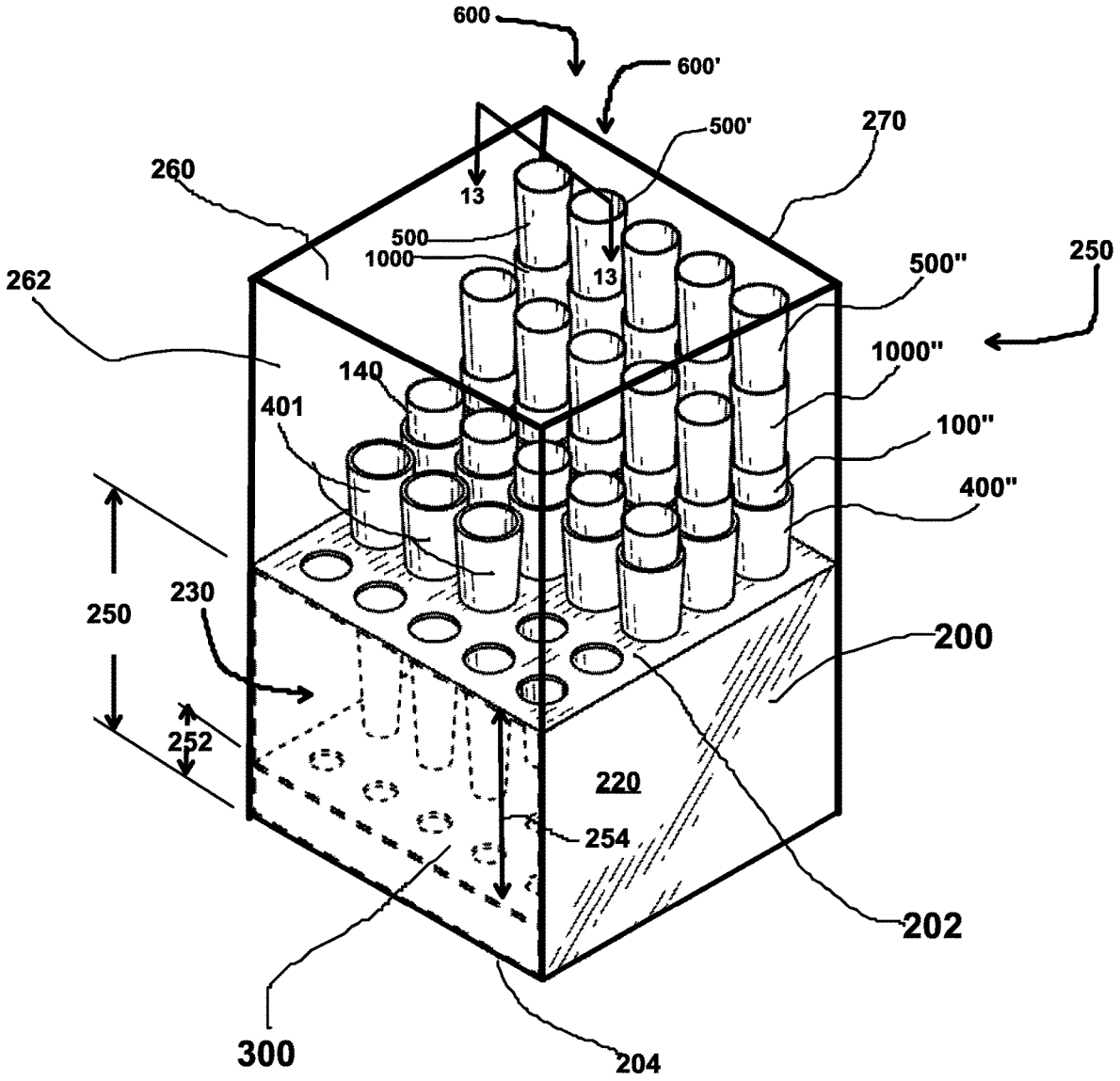
FIG. 12 is a perspective view show ng a fully closed container having a top panel, one or more side panels, an interior, and a plurality of frustoconically shaped inserts or supports supported in a generally vertical condition, with: (i) some of the frustoconical shaped inserts or supports having no conical smoking shells, (ii) other of the frustoconical shaped inserts or supports having single conical smoking shells, and (iii) still others of the frustoconical shaped inserts supports having a plurality of nested conical smoking shells along with an upper frustoconical insert or support.
Figure 13:
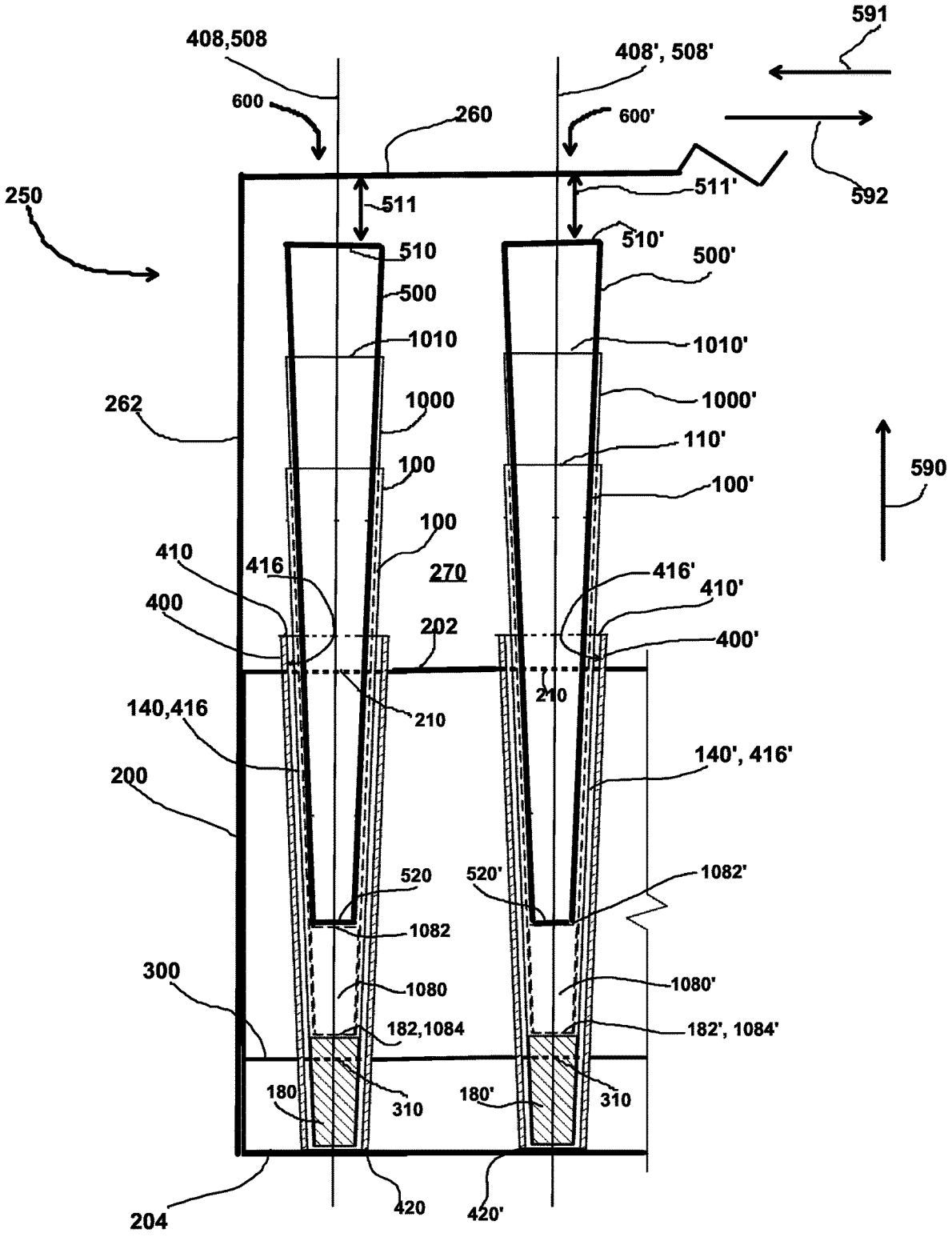
FIG. 13 is a sectional view of FIG. 12 taken along the lines 13-13 and schematically illustrating two stacks of a plurality of nested conical smokable shells with lower and upper frustoconical shaped inserts or supports on opposing ends of the stacks of plurality of nested conical smoking shells and without any wrinkling or damage to any of the sidewalls in the smoking shells.

Storage Container with Opposed Lower and Upper Frusto-Conically Shaped Insert or Supports for Stacks of Pluralities of Nested Conical Smoking Shells FIG. 11 is perspective view of an upper frustoconically shaped insert or support 500 which can be used as an upper support for each individual stack of a plurality of nested conical smoking shells (e.g., stacks 600 and 600' in FIGS. 12 and 13).

Upper frustoconically shaped insert or support 500 has a top 510, bottom 520, sidewall 530, and longitudinal centerline 508. Upper frustoconically shaped insert or support 500 can be pliable and deformable material, such as paper, plastic, metal and the like, that is capable of retaining a frustoconical shape when at least partially inserted in the interior of a conical smoking shell (e.g., conical smoking shell 100, 1000, 1100, etc.).

FIG. 12 is a perspective view showing a fully closed container 200 having a top panel 260, one or more side panels 220, an interior 270, and a plurality of first frustoconically shaped inserts or supports 400 supported in a generally vertical condition, with: (i) some of the first frustoconical shaped inserts or supports 400 having no conical smoking shells 100, 1000, 1100, etc., (ii) other of the first frustoconical shaped inserts or supports 400 having single conical smoking shells 100, and (iii) still others of the first frustoconical shaped inserts supports 400 having a plurality of nested conical smoking shells (e.g., shells 100, 1000, 1100, etc.) along with an upper frustoconical insert or support 500.

FIG. 13 is a sectional view of FIG. 12 taken along the lines 13-13 and schematically illustrating two example stacks of a plurality of nested conical smokable shells (e.g., shells 100, 1000, 1100, etc.) each having lower 400 and upper 500 frustoconical shaped inserts or supports on opposing ends of the stacks of plurality of nested conical smoking shells and without any wrinkling or damage to any of the sidewalls in the smoking shells.

The plurality of conical smoking shells can experience much movement, jerking, and/or hitting during storage which can cause individual stacks of pluralities of nested conical smoking shells to differentially move longitudinally and/or laterally in the stored state. With the use of opposed lower 400 and upper 500 frustoconically shaped inserts or supports, both ends of the individual stacks of pluralities of nested conical smoking shells can be protected.

If an individual nested stack 600, 600', etc. moves longitudinally away from bottom 204 of container 200 (schematically indicated by arrow 590 in FIG. 13) the respective upper frustoconically shaped insert or support 500 will also move in said direction of arrow 590 and first contact any resistance to further movement (e.g., when contacting top 260 of container). The stiffness of the respective upper frustoconically shaped insert or support 500 will protect from wrinkling, bending, folding, or damage the particular conical smoking shell (e.g., shell 1000) in which insert or support 500 is located.

On the other hand, if an individual stack moves laterally inside container (schematically indicated by arrows 591 and 592 in FIG. 13) the respective upper frustoconically shaped insert or support 500 will also move in said direction and first contact any resistance to further movement (e.g., when contacting a side panel 262 of closed container 200 or another upper frustoconically shaped insert or support 500'). This assumes that the height(s) of each upper frustoconically shaped insert or support 500 and 500' are roughly the same relative to each other. The stiffness of the respective upper frustoconically shaped insert or support 500 will protect from wrinkling, bending, folding, or damage the particular conical smoking shell (e.g., shell 1000) in which insert or support 500 is nested in. In the instance of contacting a second upper frustoconically shaped insert or support 500' both inserts or supports 500 and 500' will respectively protect their respective conical smoking shell from wrinkling, bending, folding, or damage (e.g., insert or support 500 protecting shell 1000 and insert or support 500' protecting shell 1000').

Figure 14:
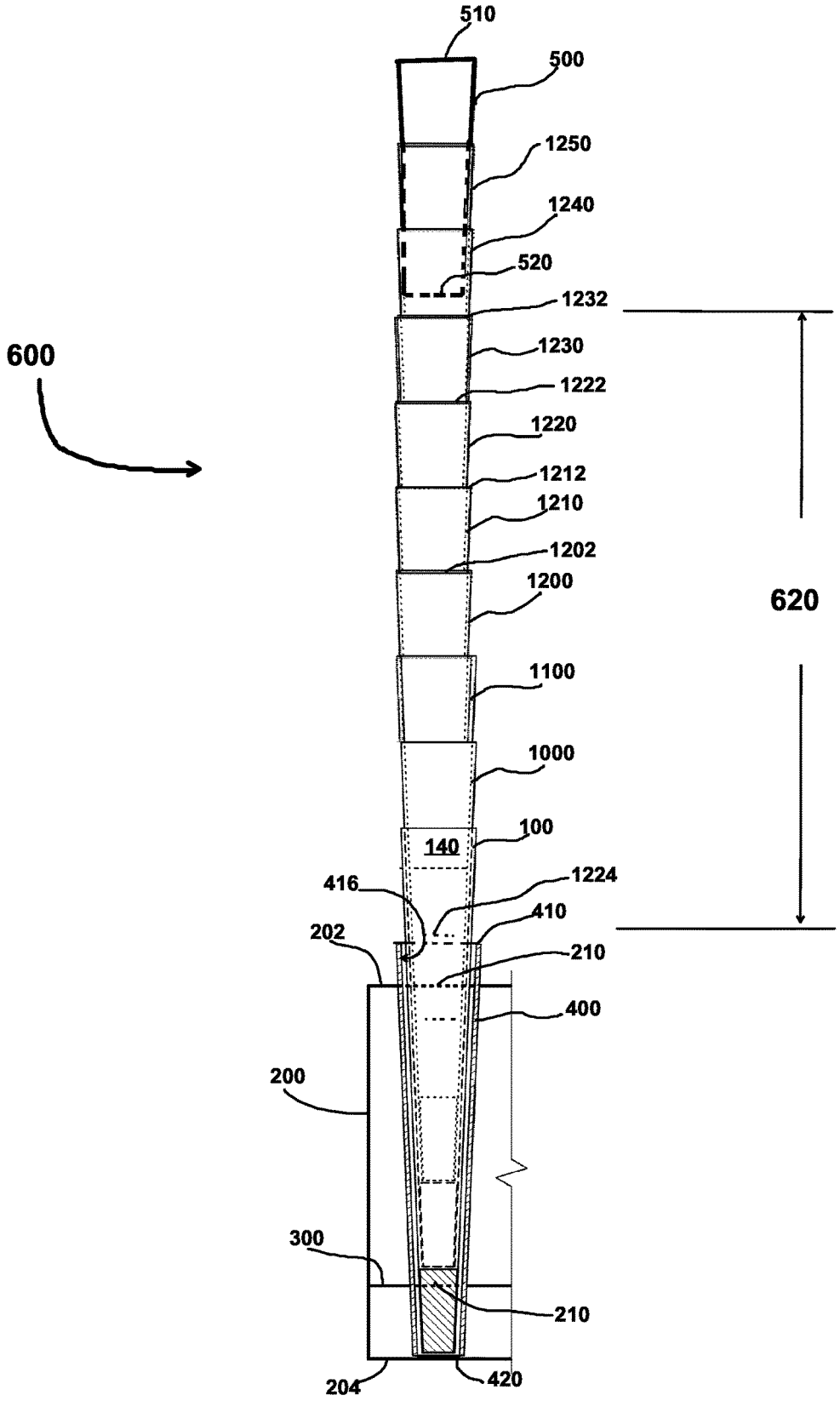
FIG. 14 is a sectional view of a stack of a large plurality of nested conical smokable shells with lower and upper frustoconical shaped inserts or supports on opposing ends of the stack of nested conical smoking shells where the lower and upper shaped inserts or supports are completely longitudinally spaced apart from each other and where there is no wrinkling or damage to any of the sidewalls in the smoking shells.

FIG. 14 is a sectional view of a stack 600 of a large plurality of nested conical smokable shells with lower 400 and upper 500 frustoconical shaped inserts or supports on opposing ends of the stack 600 of nested conical smoking shells where the lower 400 and upper 500 shaped inserts or supports are completely longitudinally spaced apart from each other and where there is no wrinkling or damage to any of the sidewalls in the smoking shells.

In various embodiments one or more stacks 600 of a plurality of nested conical smoking shells can at least have at least 5, 6, 7, 8, 9, 10, 11, 12, 13, 14, 15, 16, 17, 18, 19, or 20 nested conical smoking shells in each stack 600. In various embodiments the number of nested conical smoking shells in each nested stack 600 can fall within a range of any two of the above referenced/specified number of nested conical smoking shells.

In various embodiments one or more stacks 600 of a plurality of nested conical smoking shells can have enough nested conical smoking shells 100, 1000, 1100, 1200, 1210, 1220, 1230, 1240 etc. that the lower 400 and upper 500 frustoconical shaped inserts or supports on opposing ends of the stack 600 are spaced where the lower end 520 of the respective upper 500 frustoconical shaped insert or support is higher than the upper end 410 of the respective lower frustoconical shaped insert or support 400. In such a case, the respective upper 500 frustoconically shaped insert or support for the stack 600 would be considered completely longitudinally spaced apart its respective lower 400 frustoconically shaped insert or support for the stack 600. FIG. 14 shows a plurality of nested conical smoking shells 100, 1000, 1100, 1200, 1210, 1220, 1230, 1240 etc. causing the lower 400 and upper 500 frustoconical shaped inserts or supports to be completely longitudinally spaced apart.

For purposes of simplicity FIGS. 12 and 13 do not show enough nested conical smoking shells 100, 1000, 1100, etc. in a stack such that the respective upper frustoconically shaped insert or support 500 is completely longitudinally spaced apart from the lower frustoconically shaped insert or support 400 for the stack 600. However (with the example shown in FIG. 14), for any stack 600 of nested conical smoking shells, adding additional nested conical smoking shells to stack 600 shown in FIGS. 12 and 13 will incrementally increase the separation of upper 500 and lower 400 frustoconically shaped inserts or supports for the respective stack 600 and eventually the upper frustoconically shaped insert or support 500 will be completely longitudinally spaced apart from the lower frustoconically shaped insert or support 400 for the stack 600. Furthermore, where enough additional nested conical smoking shells are be added to the stack 600 then one or more intermediate nested conical smoking shells 620 will themselves be completely longitudinally spaced apart from both upper 500 and lower 400 frustoconically shaped inserts or supports. The one or more nested conical smoking shells 610 that are themselves spaced apart from both the completely longitudinally spaced apart upper 500 and lower 400 frustoconically shaped inserts or supports will be called intermediate nested conical smoking shell(s) 620.

In FIG. 14 conical smoking shells 1220 and 1230 are shown as being completely longitudinally spaced apart from upper 500 and lower 400 frustoconically shaped inserts or supports In various embodiments a plurality of intermediate nested conical smoking shells 620 can be in a stack 600. Area 620 shows some intermediate nested conical smoking shells (in this case conical smoking shells 1220 and 1230). In various embodiments a plurality of stacks 600, 600', 600", etc. can each respectively have a plurality of intermediate nested conical smoking shells 620. In various embodiments there are at least 1, 2, 3, 4, 5, 6, 7, 8, 9, 10, 11, 12, 13, 14, 15, 16, 17, 18, 19, or 20 intermediate nested conical smoking shells 620 in one or more of the stacks 600. In various embodiments the number of intermediate nested conical smoking shells 620 can fall within a range of any two of the above referenced/specified number of intermediate nested conical smoking shells. In various embodiments a plurality of stacks 600, 600', 600", etc. can each respectively have a plurality of intermediate nested conical smoking shells 620. In various embodiments there are at least 1, 2, 3, 4, 5, 6, 7, 8, 9, 10, 11, 12, 13, 14, 15, 16, 17, 18, 19, or 20 intermediate nested conical smoking shells 620 in one or more of the stacks 600. In various embodiments the number of intermediate nested conical smoking shells 620 can fall within a range of any two of the above referenced/specified number of intermediate nested conical smoking shells.

It has been surprisingly found that each conical smoking shell in a nested stack of conical smoking shells 600, including but not limited to the full set of intermediate nested conical smoking shell(s) 620, can be protected from wrinkling, bending, folding, or damage by the combination of the upper 500 and lower 400 frustoconically shaped insert or supports even where the frustoconically shaped insert or supports are completely longitudinally spaced apart upper 500 and lower 400 frustoconically shaped insert or supports.

In various embodiments storage container 200 can include a plurality of nested stacks 600 of conical smoking shells which each stack 600 includes intermediate nested conical smoking shell(s) 620. In various embodiments have a plurality of intermediate nested conical smoking shells 620. In various embodiments there are at least 5, 6, 7, 8, 9, 10, 11, 12, 13, 14, 15, 16, 17, 18, 19, or 20 nested stacks of conical smoking shells which each include intermediate nested conical smoking shells 620. In various embodiments the number of nested stacks of conical smoking shells 600 can fall within a range of any two of the above referenced/specified number of nested stacks of conical smoking shells 620. In various embodiments the plurality of nested stacks of conical smoking shells 600 can be in a grid or array pattern in storage container 200.

The following is a list of reference numerals:

TABLE OF REFERENCE NUMERALS:

| REFERENCE NUMBER | DESCRIPTION |
|---|---|
| 10 | storage apparatus |
| 100 | conical smoking shell |
| 101 | plurality of conical smoking shells |
| 102 | sidewall |
| 103 | set of nested conical smoking shells |
| 105 | height |
| 106 | distance |
| 107 | distance |
| 110 | first end |
| 114 | interior |
| 120 | second end |
| 130 | inner surface |
| 140 | outer surface |
| 150 | first opening |
| 160 | second opening |
| 180 | filter |
| 182 | first end of filter |
| 184 | second end of filter |
| 190 | damaged/wrinkled area |
| 196 | arrow |
| 200 | storage container |
| 202 | top of storage container |
| 204 | bottom of storage container |
| 210 | plurality of openings in top of storage container |
| 211 | dimension |
| 220 | walls or side panels |
| 230 | interior |
| 250 | cover |
| 252 | distance |
| 254 | distance |

-continued

TABLE OF REFERENCE NUMERALS:

| REFERENCE NUMBER | DESCRIPTION |
|---|---|
| 260 | top panel or openable top |
| 262 | side panel |
| 270 | upper interior of closed storage container |
| 300 | interior shelf of storage container |
| 310 | plurality of openings in interior shelf |
| 311 | dimension |
| 400 | frustoconical support insert |
| 401 | plurality of frustoconical support inserts |
| 402 | plurality of frustoconical support inserts |
| 403 | plurality of frustoconical support inserts |
| 405 | height |
| 408 | longitudinal centerline |
| 410 | top of frustoconical support insert |
| 414 | interior |
| 416 | inner sidewall |
| 420 | bottom of frustoconical support insert |
| 430 | sidewall of frustoconical support insert |
| 440 | thickness |
| 500 | upper frustoconical support insert |
| 501 | plurality of upper frustoconical support inserts |
| 502 | plurality of frustoconical support inserts |
| 503 | plurality of frustoconical support inserts |
| 505 | height |
| 508 | longitudinal centerline |
| 510 | top of frustoconical support insert |
| 511 | gap |
| 514 | interior |
| 516 | inner sidewall |
| 520 | bottom of frustoconical support insert |
| 530 | sidewall of frustoconical support insert |
| 540 | thickness |
| 590 | arrow |
| 591 | arrow |
| 592 | arrow |
| 600 | stack of nested smokable conical shells |
| 610 | one or more nested conical smoking shells |
| 620 | one of more intermediate nested conical smoking shells |
| 1000 | conical smoking shell |
| 1001 | plurality of conical smoking shells |
| 1002 | sidewall |
| 1005 | height |
| 1010 | first end |
| 1014 | interior |
| 1020 | second end |
| 1030 | inner surface |
| 1040 | outer surface |
| 1050 | first opening |
| 1060 | second opening |
| 1080 | filter |
| 1082 | first end of filter |
| 1084 | second end of filter |
| 1090 | wrinkling, bending, or damage |
| 1092 | wrinkling, bending, or damage |
| 1100 | conical smoking shell |
| 1101 | plurality of conical smoking shells |
| 1102 | sidewall |
| 1105 | height |
| 1110 | first end |
| 1114 | interior |
| 1120 | second end |
| 1130 | inner surface |
| 1140 | outer surface |
| 1150 | first opening |
| 1160 | second opening |
| 1180 | filter |
| 1182 | first end of filter |
| 1184 | second end of filter |
| 1192 | wrinkling, bending, or damage |
| 1200 | conical smoking shell |
| 1202 | first end |
| 1204 | second end |
| 1210 | conical smoking shell |
| 1212 | first end |

-continued

TABLE OF REFERENCE NUMERALS:

| REFERENCE NUMBER | DESCRIPTION |
|---|---|
| 1214 | second end |
| 1220 | conical smoking shell |
| 1222 | first end |
| 1224 | second end |
| 1230 | conical smoking shell |
| 1232 | first end |
| 1234 | second end |
| 1240 | conical smoking shell |
| 1242 | first end |
| 1244 | second end |
| 1250 | conical smoking shell |
| 1252 | first end |
| 1254 | second end |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A packaged smoking apparatus that generates a plurality of smokable articles, comprising:

a) a package having top and bottom portions and an interior located between the top and bottom portions;

b) a plurality of nested stacks of conical smoking shells, wherein each nested stack in the plurality of nested stacks of conical smoking shells includes:

(i) a first plurality of conical smoking shells, each being a hollow, conically shaped smokable shell, each with a shell interior and filter tip located in the shell interior, the smokable shell having a shell stiffness, wherein the first plurality of conical smoking shells are in a nested state forming a stack having upper and lower stack ends;

(ii) a first reinforcing cone having a first reinforcing interior, wherein the first reinforcing interior is able to accommodate a first conical smoking shell located at the lower stack end, the first reinforcing cone having a first stiffness that is greater than the shell stiffness of each of the first plurality of conical smoking shells;

(iii) a second reinforcing cone that fits inside the shell interior of a second conical smoking shell located at the upper stack end, the second reinforcing cone having a second stiffness that is greater than the shell stiffness of each of the first plurality of conical smoking shells;

(iv) wherein at least one nested conical smoking shell from the first plurality of conical smoking shells is spaced completely apart from both the first reinforcing cone and second reinforcing cone; and c) wherein the plurality of nested stacks of conical smoking shells are packaged for sale inside the package with the top portion of the packaging preventing each of the plurality of nested stacks of conical smoking shells from leaving their respective nested states, and wherein each of the second reinforcing cones preventing the plurality of conical smoking shells in its respective stack from contacting the top portion of the package.

2. The smoking apparatus of claim 1, wherein each nested stack of conical smoking shells in the plurality of nested stack of conical smoking shells includes at least 5 conical smoking shells.

3. The smoking apparatus of claim 1, wherein each nested stack of conical smoking shells in the plurality of nested stack of conical smoking shells includes at least 10 conical smoking shells.

4. The smoking apparatus of claim 1, wherein in the nested state the filter tip of each conical smoking shell in each first plurality of smoking shells is in contact with the filter tip of another conical smoking shell in the first plurality of smoking shells.

5. The smoking apparatus of claim 1, wherein a plurality of nested conical smoking shells from each first plurality of conical smoking are spaced completely apart from both the first reinforcing cone and the second reinforcing cone.

6. The smoking apparatus of claim 1, wherein a gap between each second reinforcing cone in a respective stack of conical smoking shells and the top portion of the package is less than a predefined amount preventing the first plurality of conical smoking shells from leaving the nested state.

7. The smoking apparatus of claim 6, wherein there the gap is less than 0.5 inch.

8. The smoking apparatus of claim 6, wherein gap is between 0 and 0.25 inches.

9. The smoking apparatus of claim 1, further comprising d) a container having one or more side panels, a top panel connected to the one or more side panels, and an interior;

e) the top panel having a plurality of upper openings;

f) the first reinforcing cone for each of the plurality of nested stacks removably fitting in one of the plurality of upper openings, wherein each of the plurality of nested stacks are held in a generally vertical state.

10. The smoking apparatus of claim 9, wherein the container is a box having multiple flat sides.

11. The smoking apparatus of claim 9, wherein the container includes a lower panel having a plurality of lower openings generally aligned with the plurality of upper openings, wherein the plurality of lower openings are smaller than the plurality of upper openings, and each of first reinforcing cones of the plurality of nested stacks are detachably supported by one of the plurality of upper openings and one of the plurality of lower openings.

12. The smoking apparatus of claim 11, wherein each of first reinforcing cones of the plurality of nested stacks are held above the bottom of the package.

13. The smoking apparatus of claim 9, wherein each of the first reinforcing cones in the plurality of nested stacks have upper insert surfaces and each of the plurality of conical smoking shells in the respective nested stack have upper shell surfaces that are located above the respective upper support surface of the first reinforcing cone.

14. The packaged smoking apparatus of claim 13, wherein the first and second reinforcing cones are spaced apart but remain at least partially nested together.

15. The smoking apparatus of claim 1, wherein the first stiffness is greater than the second stiffness.

16. The smoking apparatus of claim 1, wherein the first stiffness is at least 25 percent greater than the second stiffness.

17. The smoking apparatus of claim 1, wherein the first stiffness is at least 50 percent greater than the second stiffness.

18. The smoking apparatus of claim 1, wherein the first stiffness is at two times that of the second stiffness.

19. The smoking apparatus of claim 1, wherein for each first plurality of conical smoking shells, the first and second reinforcing cones located at opposing ends of the individual nested stack of conical smoking cones are vertically spaced apart from each other.

20. A packaged smoking apparatus that generates a plurality of smokable articles, comprising:

a) a package having top and bottom portions and an interior located between the top and bottom portions;

b) a plurality of nested stacks of conical smoking shells, wherein each nested stack in the plurality of nested stacks of conical smoking shells includes:

(i) a first plurality of conical smoking shells, each being a hollow, conically shaped smokable shell, each with a shell interior, wherein the first plurality of conical smoking shells are in a nested state forming a stack having upper and lower stack ends;

(ii) a first reinforcing cone having a first reinforcing interior, wherein the first reinforcing interior is able to accommodate a first conical smoking shell located at the lower stack end, the first reinforcing cone having a first stiffness that is greater than the stiffness of each of the first plurality of conical smoking shells;

(iii) a second reinforcing cone that fits inside the shell interior of a second conical smoking shell located at the upper stack end, the second reinforcing cone having a second stiffness that is greater than the stiffness of each of the first plurality of conical smoking shells;

(iv) wherein the first and second reinforcing cones are spaced apart from one another; and c) wherein the plurality of nested stacks of conical smoking shells are packaged for sale inside the package, and wherein each of the second reinforcing cones preventing the plurality of conical smoking shells in its respective stack from contacting the top portion of the package.

* * * * *